US010549295B2

(12) United States Patent
Adam

(10) Patent No.: US 10,549,295 B2
(45) Date of Patent: Feb. 4, 2020

(54) FLUID PRODUCT DISPENSER

(71) Applicant: APTAR FRANCE SAS, Le Neubourg (FR)

(72) Inventor: Fabien Adam, Aviron (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 16/072,280

(22) PCT Filed: Feb. 6, 2017

(86) PCT No.: PCT/FR2017/050263
§ 371 (c)(1),
(2) Date: Jul. 25, 2018

(87) PCT Pub. No.: WO2017/137684
PCT Pub. Date: Aug. 17, 2017

(65) Prior Publication Data

US 2019/0022680 A1 Jan. 24, 2019

(30) Foreign Application Priority Data

Feb. 12, 2016 (FR) ..... 16 51131

(51) Int. Cl.
*B05B 11/04* (2006.01)
*B05B 11/00* (2006.01)

(52) U.S. Cl.
CPC ..... *B05B 11/048* (2013.01); *B05B 11/007* (2013.01); *B05B 11/0044* (2018.08); *B05B 11/0072* (2013.01); *B05B 11/047* (2013.01)

(58) Field of Classification Search
CPC .. B05B 11/048; B05B 11/047; B05B 11/0044
See application file for complete search history.

(56) References Cited

U.S. PATENT DOCUMENTS 5,108,007 A * 4/1992 Smith ..... B05B 11/0072 222/209
5,183,184 A * 2/1993 Ranalletta ..... B05B 11/007 222/189.09

(Continued)

FOREIGN PATENT DOCUMENTS

DE 20 2014 001 720 U1 4/2015
FR 2821766 A1 9/2002
WO 2015/085021 A1 6/2015

OTHER PUBLICATIONS

International Search Report for PCT/FR2017/050263 dated May 18, 2017.

*Primary Examiner* — Jeremy Carroll
(74) *Attorney, Agent, or Firm* — Sughrue Mion, PLLC

(57) ABSTRACT

A fluid dispenser comprising a deformable outer shell (1) and a flexible inner pouch (2) that is arranged inside the shell (1) in such a manner as to define between them a compression space (E) that is filled with air, the pouch (2) containing a fluid for dispensing through a dispenser valve (4), the compression space (E) communicating with the outside through an air inlet valve (5), such that deformation of the shell (1) puts the air contained in the compression space (E) under pressure, the air under pressure acting on the pouch (2), so that the fluid therein is then forced through the dispenser valve (4), the dispenser also comprising a head (3) that is fitted on the shell (1) and on the pouch (2), the head (3) comprising a first valve support (34) on which the dispenser valve (4) is mounted, and a second valve support (35) on which the air inlet valve (5) is mounted;

the dispenser being characterized in that it further comprises a hood (6) that is fastened in non-leaktight manner on the deformable outer shell (1), the hood (6) holding the head (3) in place on the deformable outer (Continued)

shell (1) and on the flexible inner pouch (21), the hood (6) including a window (63) in which the dispenser valve (4) is positioned.

16 Claims, 3 Drawing Sheets

(56) References Cited

U.S. PATENT DOCUMENTS

| | | | | |
|---|---|---|---|---|
| 5,320,254 | A * | 6/1994 | Ranalletta | B05B 11/007 222/189.08 |
| 6,523,711 | B1 * | 2/2003 | Hughes | A47G 19/2266 215/308 |
| 2016/0304250 | A1 * | 10/2016 | Simpson | B65D 35/46 |
| 2017/0056904 | A1 | 3/2017 | Brugger | |

* cited by examiner

FLUID PRODUCT DISPENSER

CROSS REFERENCE TO RELATED APPLICATIONS

This application is a National Stage of International Application No. PCT/FR2017/050263 filed Feb. 6, 2017, claiming priority based on French Patent Application No. 1651131 filed Feb. 12, 2016.

The present invention relates to a fluid dispenser comprising a deformable outer shell and a flexible inner pouch that is arranged inside the deformable outer shell in such a manner as to define between them a compression space that is filled with air, the flexible inner pouch containing a fluid for dispensing through a fluid dispenser valve, the compression space communicating with the outside through an air inlet valve, such that deformation of the deformable outer shell closes the air inlet valve and puts the air contained in the compression space under pressure, the air under pressure acting on the flexible inner pouch, so that the fluid therein is then forced through the fluid dispenser valve. That type of dispenser finds an advantageous application in the fields of cosmetics, pharmacy, and perfumery.

In the prior art, and by way of example, document FR 2 821 766 is known, which describes a dispenser of that type, comprising a squeezable outer shell that is provided with an air inlet valve, and a flexible inner pouch that is provided with a dispenser head. Squeezing the outer shell causes the air inlet valve to be flattened into its closed position, and causes the air contained in the shell to be put under pressure. The flexible pouch is subjected to the pressure of the air, thereby causing the fluid that it contains to be forced towards, and through, the dispenser head. In that document, the flexible pouch is heat-sealed directly to the dispenser head, which is secured to the outer shell. Furthermore, the dispenser head includes a fluid dispenser valve in the form of a deformable sleeve that is incorporated with the dispenser head.

As a result of the air inlet valve being arranged on the deformable outer shell, the general appearance of the dispenser is adversely affected, since the user immediately observes the air inlet valve that, in that embodiment is arranged at the very bottom of the deformable outer shell, remote from the dispenser head. Furthermore, incorporating the dispenser head inside the deformable outer shell and fastening the flexible pouch directly to the dispenser head are characteristics that do not make it easy to assemble or mount the dispenser.

In the prior art, documents WO 2015/085021 and DE 20 2014 001 720 are known, which describe dispensers including a fluid dispenser valve and an air inlet valve that are mounted on a single support.

The objects of the present invention are various, but make it possible in particular to improve the overall appearance of the dispenser and make it easier to mount and to assemble.

To achieve these objects, the present invention proposes a fluid dispenser comprising a deformable outer shell and a flexible inner pouch that is arranged inside the deformable outer shell in such a manner as to define between them a compression space that is filled with air, the flexible inner pouch containing a fluid for dispensing through a fluid dispenser valve, the compression space communicating with the outside through an air inlet valve, such that deformation of the deformable outer shell closes the air inlet valve and puts the air contained in the compression space under pressure, the air under pressure acting on the flexible inner pouch, so that the fluid therein is then forced through the fluid dispenser valve, the dispenser also comprising a head that is fitted on the deformable outer shell and on the flexible inner pouch, the head comprising a first valve support on which the fluid dispenser valve is mounted, and a second valve support on which the air inlet valve is mounted; the dispenser further comprising a hood that is fastened in non-leaktight manner on the deformable outer shell, the hood holding the head in place on the deformable outer shell and on the flexible inner pouch, the hood including a window in which the dispenser valve is positioned.

Thus, the head may merely be fitted and/or placed on the shell and on the pouch without being fastened mechanically thereto. Fastening the hood on the shell in non-leaktight manner makes it possible to supply the air inlet valve with outside air. Advantageously, the hood holds the dispenser valve in place on the first valve support. In this way, the dispenser valve does not itself even need to be fastened mechanically on its valve support: e.g. the dispenser valve may be jammed between the hood and its valve support. It is fastening the hood on the shell that guarantees that the dispenser valve is held in place in leaktight manner. In addition, the hood may mask the head and the air inlet valve. Thus, the user need not even know that the dispenser is provided with an air inlet valve mounted on a head that also serves as a support for the dispenser valve. To summarize, the only visible portions of the dispenser are the outer shell, the hood, and the visible portion of the dispenser valve.

According to an advantageous characteristic of the invention, the second valve support forms a valve seat, the air inlet valve and the valve seat defining between them a calibrated leakage path, when the air inlet valve is pressed against its valve seat. Preferably, the calibrated leakage path is in the form of a channel that interrupts the valve seat. In this way it is possible to avoid any accidental dispensing of fluid associated with slow variations in pressure and/or temperature, in particular when travelling in the hold of a plane. It should be observed that the calibrated leakage path may be implemented separately, i.e. on any dispenser that has a squeezable shell and that is provided with an air inlet valve that puts the outside environment into communication with a space defined between a flexible pouch containing the fluid and the squeezable outer shell that contains the flexible pouch.

In another advantageous aspect of the present invention, the dispenser valve may be a valve having a self-sealing slot, and advantageously including an anchor skirt that co-operates with the first valve support. The use of a valve having a self-sealing slot presents the advantage that the dispenser opening formed by the self-sealing slot is not visible when the dispenser is at rest. As a result, the valve having a self-sealing slot may smoothly finish off the hood at its window, e.g. by arranging the valve in alignment with the outer wall of the hood.

In another advantageous aspect of the invention, the air inlet valve is open at rest and closed when the deformable outer shell is squeezed. In this way, the compression space is always at atmospheric pressure when the dispenser is at rest. This avoids any accidental triggering in the event of variations in temperature or pressure. Specifically, if the valve is leaktight at rest, the above-mentioned variations could cause a difference in internal and external pressures, and thus put the pouch under pressure in uncontrolled manner, which could cause unwanted dispensing.

In a practical embodiment, the air inlet valve comprises a deformable brim that is secured to an anchor rod that is held captive by a borehole of the head that acts as a second valve support. The deformable brim may be spaced apart from its seat when the dispenser is at rest.

According to another advantageous characteristic of the invention, the flexible inner pouch includes a pouch support that defines a pouch opening, and the head includes a duct that connects the opening to the dispenser valve, the first valve support being formed by the duct. Advantageously, the pouch support includes an annular collar that bears against an annular flange of the deformable outer shell that is advantageously made as a single piece. This means that the flexible pouch with its pouch support is inserted into the outer shell through its annular flange. Preferably, the head comes into engagement with the pouch support so as to hold the collar in place in stationary manner on the flange. Advantageously, the collar forms at least one through passage that puts the compression space directly into communication with a valve chamber in which the second valve support is formed. Preferably, the first valve support is situated outside the valve chamber. Thus, there is no risk of fluid leaking through the dispenser valve into the valve chamber, and from there towards the compression space.

The spirit of the invention resides in supporting the dispenser and air inlet valves on a part that is fitted, or merely placed, on the shell and on the pouch. The use of a hood to lock and hold the head in place on the shell and on the pouch is another advantageous characteristic of the invention. A clear separation between the dispenser valve and the air inlet valve makes it possible to prevent any mixing.

The invention is described below in greater detail with reference to the accompanying drawings, which show an embodiment of the invention by way of non-limiting example.

Figure 1:
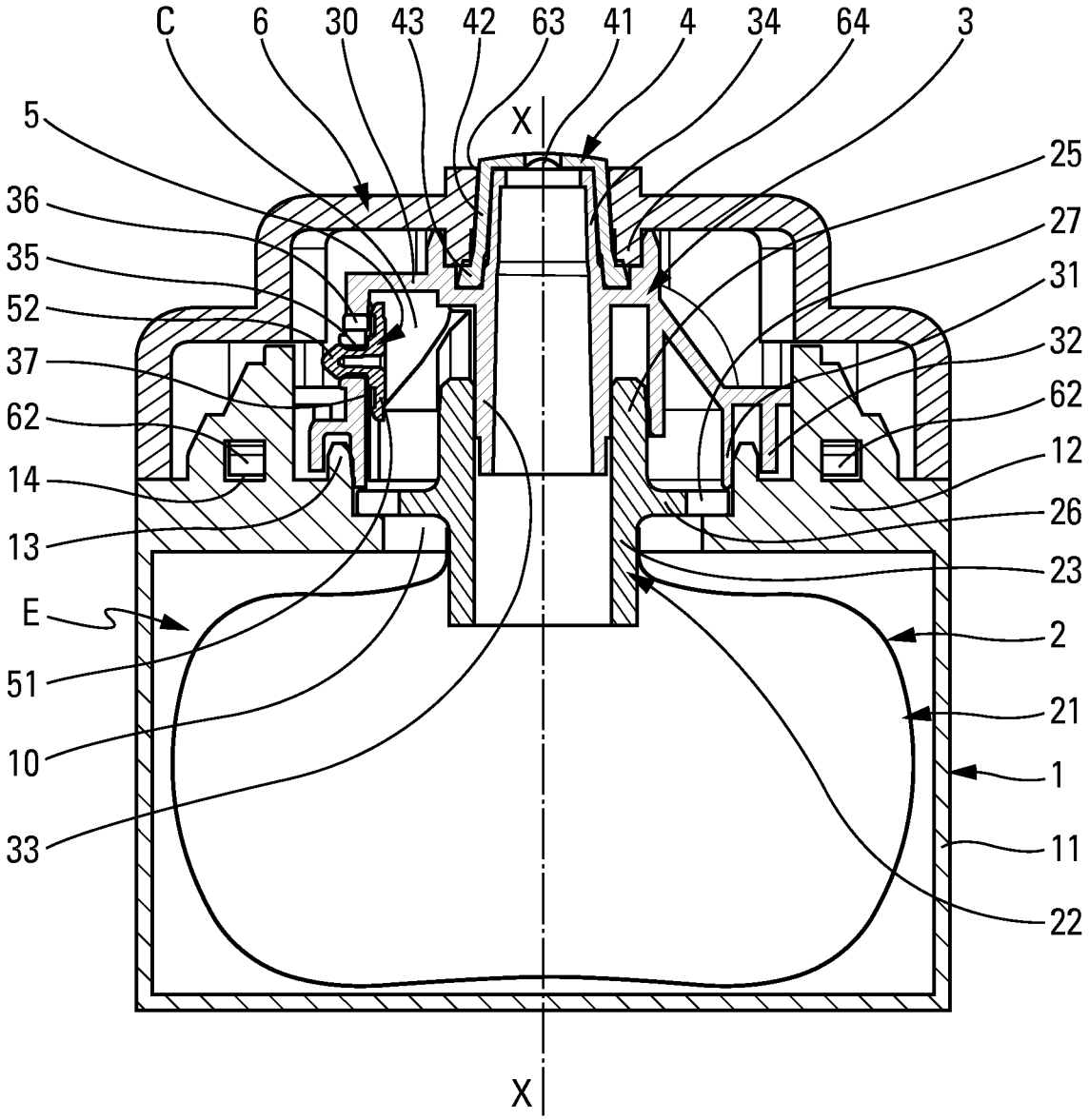
FIG. 1 is a vertical section view through a dispenser in a non-limiting embodiment of the invention.
Figure 2:
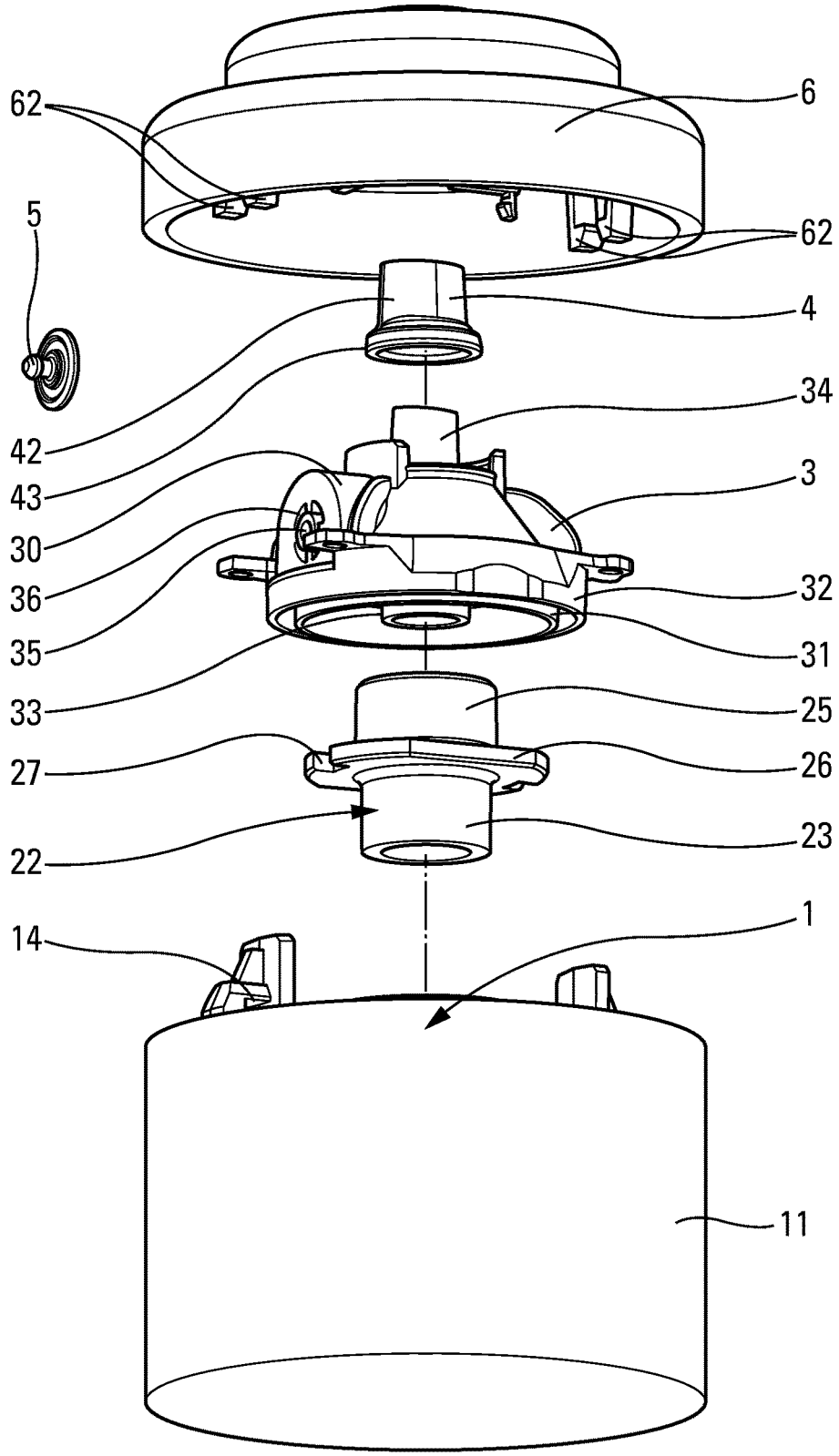
FIG. 2 is an exploded perspective view of the FIG. 1 fluid dispenser.

Reference is made to both of FIGS. 1 and 2 while describing in detail the structure and the operation of a fluid dispenser made in accordance with the invention. The dispenser comprises a plurality of component elements, namely: a deformable outer shell 1; a flexible inner pouch 2; a head 3; a fluid dispenser valve 4; an air inlet valve 5; and a hood 6. Most of the component elements may be made by injection-molding an appropriate plastics material. They are assembled together along a longitudinal axis.

The deformable outer shell 1 is preferably made as a single piece and may present any shape that is suitable for being deformed or squeezed by hand. In greater detail, the shell 1 comprises a covering body 11 to which an annular flange 12 is connected at its top portion, which annular flange defines an access passage 10 that gives access to the inside of the covering body 11. The annular flange 12 forms an annular rib 13 that projects upwards in the proximity of the access passage 10. The annular flange 12 also forms two fastener lugs 14 that are arranged in diametrically-opposite manner outside the annular rib 13. In this embodiment, the annular flange 12 is connected integrally with the covering body 11, but it is also possible to envisage that the flange 12 is a separate piece fastened in any manner on the covering body 11.

The flexible inner pouch 2 could be made as a single piece, but it preferably comprises a bag 21 that is fastened, advantageously by heat-sealing, to a pouch support 22. By way of example, the bag 21 may be made from a laminate that comprises aluminum and plastics material. The bag 21 defines an opening in which the pouch support 22 is engaged. The bag 21 is heat-sealed to the pouch support 22 via a heat-sealing appendage 23. Above the heat-sealing appendage 23, the pouch support 22 forms a neck 25 that defines a pouch opening. The pouch support 22 also includes an annular collar 26 that extends radially outwards around the neck 25. As can be seen in the figures, the neck 25 projects axially upwards above the annular collar 26. It should also be observed that the collar 26 is formed with a plurality of passages 27. As can be seen in FIG. 1, the flexible pouch 2 is arranged inside the outer shell 1 with the annular collar 26 bearing axially against the annular flange 12 of the shell. The neck 25 projects upwards relative to the annular flange 12, and the passages 27 provide direct communication with a compression space E that is defined between the flexible pouch 2 and the deformable shell 1. Naturally, the inside of the bag 21 communicates with the outside through the pouch support, and in particular through the fastener appendage 23 and the neck 25.

The head 3 is also preferably made as a single piece, although an embodiment made of a plurality of distinct pieces is possible. The head 3 is fitted or placed on the shell 1 and on the pouch 2 in completely axial manner. Initially, the head 3 includes two annular lips 31 and 32 that come to be positioned around the annular rib 13 of the flange 12. As can be seen in FIG. 2, the inner lip 31 comes to be positioned inside the rib 13, and also comes into contact with the annular collar 26 of the pouch support 22, thereby holding the pouch 2 in place in the shell 1. The head 3 also includes a duct 33 having a bottom portion that is engaged inside the neck 25, advantageously in leaktight manner. The top portion of the duct 33 forms a first valve support 34 that opens axially upwards. The head 3 also forms a bell 30 that connects the duct 33 to the two lips 31 and 32. The inside of the bell 30 defines a valve chamber C that communicates with the compression space E through the passages 27 in the collar 26. The bell 30 defines a second valve support 35 in the form of a borehole. The wall of the bell 30 is also perforated with one or more slots 36 putting the valve chamber C into communication with the outside of the head. The inside wall of the bell 30 around the second pouch support 35 advantageously defines a valve seat 37. In summary, the head 3 is arranged axially on the shell 1 and the pouch 2 and defines a duct 33 that connects the inside of the bag 21 with a first valve support 34, and a valve chamber C that connects the compression space E to a second valve support 35 through the through passages 27 in the collar 26 that bears against the flange 12.

In the invention, the fluid dispenser valve 4 is mounted on the first valve support 34, thereby closing the top end of the duct 33. The dispenser valve 4 may be fastened in any manner on the first valve support 34. In the embodiment in the figures, the dispenser valve 4 includes a skirt 42 that extends around the first valve support 34. At its bottom end, the skirt defines an annular anchor stub 43 that comes to bear against the head 3. Advantageously, the dispenser valve 4 includes a self-sealing slot 41, e.g. in the form of a rectilinear or cross-shaped slot, that closes in leaktight manner at rest. In contrast, when the slot is subjected to sufficient pressure, it opens and allows fluid to pass. This type of dispenser valve presents the advantage that, in the rest state, the slot is barely visible to the naked eye.

Figure 3:
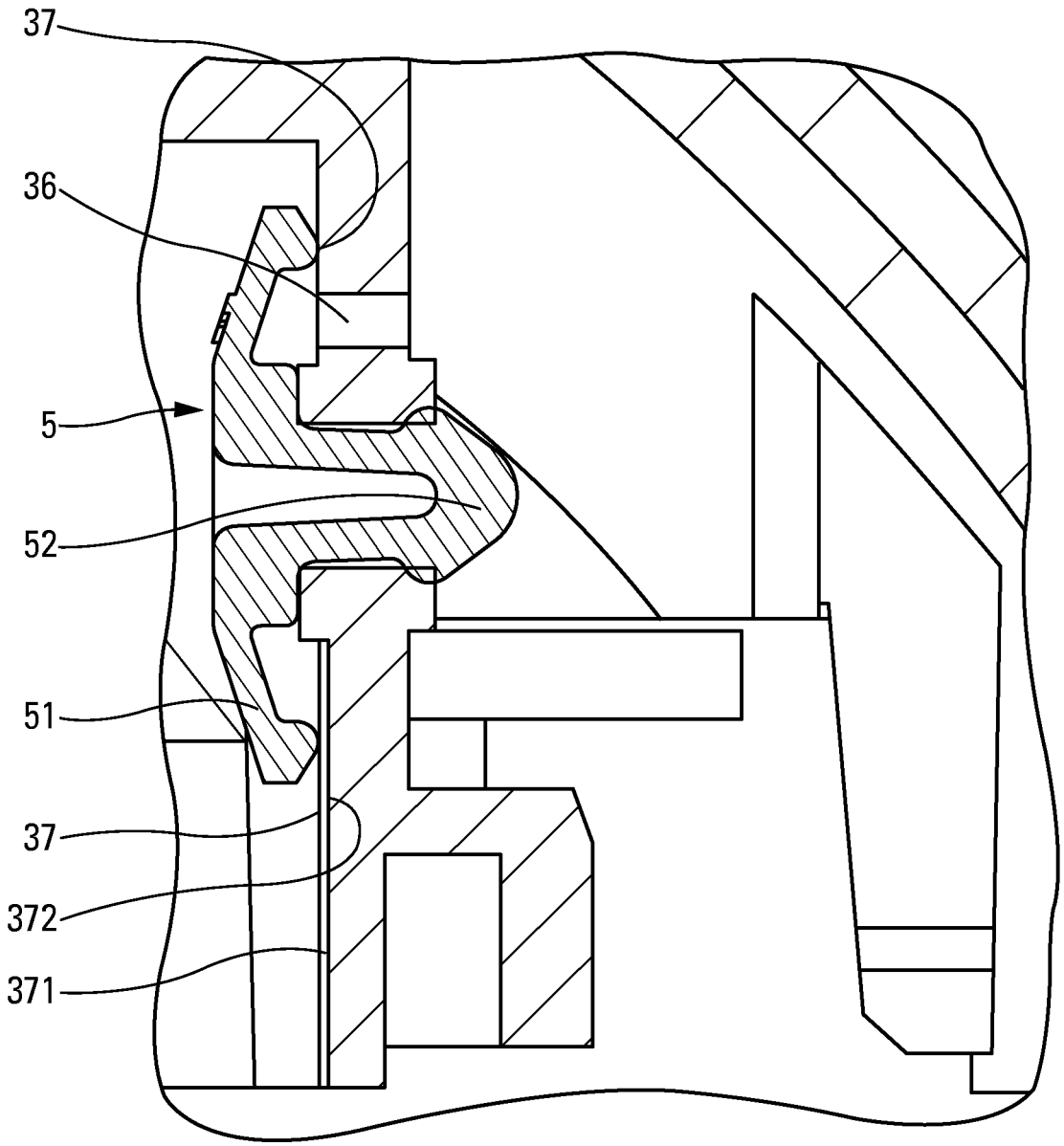
FIG. 3 is a very greatly enlarged section view of the air inlet valve 5 pressed against its support 35.

The air inlet valve 5 may be of any kind, but in the embodiment in the figures, it is in the form of an annular brim 51 that is associated with an anchor rod 52 that passes through the borehole of the second valve support 35. The anchor rod 52 may be stationary or movable inside the borehole: either way, it is held captive. The brim 51 extends outwards in such a manner as to cover the slots 36. It its rest position, the brim 51 is advantageously spaced apart from its seat 37, which may advantageously be formed with a channel 372 that interrupts the continuity of the valve seat 37, as can be seen in FIG. 3. When the brim 51 is pressed against the seat 37, as shown in FIG. 3, the channel 372 forms a calibrated leakage path (371) through which a very small quantity of air can pass. In normal use, the calibrated leakage path (371) generates no perceptible effect. In contrast, by way of example, when the dispenser is subjected to a progressive drop in pressure, as in the hold of an airplane climbing to its cruising altitude, the calibrated leakage path (371) enables sufficient air to pass to ensure that pressure is balanced on either side of the deformable outer shell (1). The channel 372 is preferably axial to facilitate molding. Its section is calibrated in empirical manner so that it is ineffective while the shell 1 is being squeezed rapidly, but is effective during slow variations in pressure and/or temperature. Without the calibrated leakage path (371), the dispenser would suffer a leak that would degrade its quality of use.

In a variant of the channel 372, the valve seat 37 may present a cylindrical concave shape, such that in the rest position the brim 51 bears against its seat only at two opposite points. This avoids any accidental triggering in the event of slow and progressive variations in temperature or pressure. Whenever the pressure rises suddenly in the valve chamber C, the brim 51 deforms so as to come into leaktight contact with its seat 37, thereby interrupting communication between the chamber of the valve C and the slots 35.

The channel 372 or the concave seat may be incorporated in any dispenser having a squeezable shell, independently of the fact that the two valves are mounted on a single support.

In this embodiment, the hood 6 is in the shape of a dome 61 that is fastened to the shell 2, advantageously in non-leaktight manner. More precisely, the dome 61 includes fastener hooks 62 that come into engagement, advantageously snap-fastening engagement, with the fastener lugs 14 of the flange 12. Thus, the hood 6 is stationary and securely attached to the shell 1. At its top end, the hood 6 defines a central axial window 63 in which there is arranged the dispenser valve 4, and more precisely its self-sealing slot 41. Around the window 63, the hood 6 forms a collar 64 that extends downwards so as to come into bearing contact both with the anchor stub 42 of the dispenser valve 4 and with the head 3. Thus, in simultaneous manner, the head 3 is held in place on the shell 1 and the pouch 2, and the dispenser valve 4 is held in place on its first valve support 34. Naturally, when the dispenser valve 4 is itself fastened directly to its valve support, the hood 6 does not participate in holding the valve in place.

It should be observed that the hood 6 completely masks the head 3 and the air inlet valve 5 which nevertheless communicates with the outside of the dispenser given that the hood 6 is mounted in non-leaktight manner on the shell 1. Only the dispenser valve 4 is visible through the window 63.

Advantageously, the visible portion of the dispenser valve 4 lies flush with the edge of the window 63 in such a manner as to finish it off. Thus, the dispenser valve 4 cannot be seen at all, or at worst is barely perceptible from the outside. For a user, the dispenser amounts to two parts, namely the deformable outer shell 1 and the hood 6.

The dispenser may optionally be provided with a protective cap that comes to cover the hood 6 and the dispenser valve 4. By way of example, the protective cap may be snap-fastened in removable manner on the outer periphery of the hood 6 or of the shell 1.

With the head of the present invention, it should also be observed that the duct 33 that supports the dispenser valve 4 is completely independent of, or isolated from, the valve chamber C in which the air inlet valve 5 is situated. Thus, the paths followed by the fluid and by air are completely distinct, such that a fluid leak at the outlet valve 4 cannot collapse into the valve chamber C, and vice versa. It should also be observed that the dispenser is extremely simple to assemble, since the various component elements are merely stacked axially one on another, with the hood 6 coming to lock them all together. As a result of the pouch support 22 being held both on the outer periphery of its annular collar 26 and at its neck 25, it is possible to guarantee complete stability of the pouch 2 inside the shell 1. It should also be observed that the collar 26 and the neck 25 co-operate with the bell 30 to define the valve chamber C. The passages 27 put the valve chamber C directly into communication with the compression space E.

By means of the invention, a dispenser is obtained having a pouch that is compressible in pneumatic manner, and having a dispenser valve and an air inlet valve that are supported by a head that is locked in place by a hood that is fastened on the shell.

The invention claimed is:

1. A fluid dispenser comprising a deformable outer shell and a flexible inner pouch that is arranged inside the deformable outer shell in such a manner as to define between them a compression space that is filled with air, the flexible inner pouch containing a fluid for dispensing through a fluid dispenser valve, the compression space communicating with the outside through an air inlet valve, such that deformation of the deformable outer shell closes the air inlet valve and puts the air contained in the compression space under pressure, the air under pressure acting on the flexible inner pouch, so that the fluid therein is then forced through the fluid dispenser valve, the dispenser also comprising a head that is fitted on the deformable outer shell and on the flexible inner pouch, the head comprising a first valve support on which the fluid dispenser valve is mounted, and a second valve support on which the air inlet valve is mounted;

the dispenser further comprises a hood that is fastened in non-leaktight manner on the deformable outer shell, the hood holding the head in place on the deformable outer shell and on the flexible inner pouch, the hood including a window in which the dispenser valve is positioned.

2. The dispenser according to claim 1, wherein the hood holds the dispenser valve in place on the first valve support.

3. The dispenser according to claim 2, wherein the hood masks the head and the air inlet valve.

4. The dispenser according to claim 1, wherein the dispenser valve is a valve having a self-sealing slot.

5. The dispenser according to claim 1, wherein the air inlet valve is open at rest and closed when the deformable outer shell is squeezed.

6. The dispenser according to claim 1, wherein the second valve support forms a valve seat, the air inlet valve and the valve seat defining between them a calibrated leakage path, when the air inlet valve is pressed against its valve seat.

7. The dispenser according to claim 1, wherein a calibrated leakage path is provided in a form of a channel that interrupts the valve seat.

8. The dispenser according to claim 1, wherein the air inlet valve comprises a deformable brim that is secured to an anchor rod that is held captive by a borehole of the head that acts as a second valve support.

9. The dispenser according to claim 1, wherein the flexible inner pouch includes a pouch support that defines a pouch opening, and the head includes a duct that connects the pouch opening to the dispenser valve, the first valve support being formed by the duct.

10. The dispenser according to claim 9, wherein the pouch support includes an annular collar that bears against an annular flange of the deformable outer shell that is made as a single piece.

11. The dispenser according to claim 9, wherein the pouch support includes an annular collar that bears against an annular flange of the deformable outer shell.

12. The dispenser according to claim 11, wherein the head comes into engagement with the pouch support so as to hold the collar in place in stationary manner on the flange.

13. The dispenser according to claim 11, wherein the collar forms at least one through passage that puts the compression space (E) directly into communication with a valve chamber (C) in which the second valve support is formed.

14. The dispenser according to claim 13, wherein the first valve support is situated outside the valve chamber (C).

15. The dispenser according to claim 1, wherein the dispenser valve is a valve having a self-sealing slot and includes an anchor skirt that co-operates with the first valve support.

16. A fluid dispenser comprising:

a deformable outer shell;

a flexible inner pouch disposed inside the deformable outer shell;

a compression space between the deformable outer shell and the flexible inner pouch;

a fluid contained within the flexible inner pouch;

a fluid dispenser valve from which the fluid contained within the flexible inner pouch is dispensed from the dispenser;

an air inlet valve configured to provide one-way flow of air from outside the fluid dispenser and into the compression space, wherein deformation of the deformable outer shell closes the air inlet valve and increases pressure of air contained in the compression space, which in turn acts on the flexible inner pouch so that the fluid contained within the flexible inner pouch is forced through the fluid dispenser valve;

a head fitted to the deformable outer shell and to the flexible inner pouch, the head comprising a first valve support on which the fluid dispenser valve is mounted, and a second valve support on which the air inlet valve is mounted; and a hood fastened in non-leaktight manner and directly to the deformable outer shell, the hood holding the head in place on the deformable outer shell and on the flexible inner pouch, the hood including a window at an upper distal end of the hood in which the dispenser valve is supported.

* * * * *